US005301815A

United States Patent [19]

Chauvin et al.

[11] Patent Number: 5,301,815

[45] Date of Patent: Apr. 12, 1994

[54] SCREENING DEVICE AND METHOD

[75] Inventors: Gilles Chauvin; Xavier Grasset, both of Saint-Ismier, France

[73] Assignee: Etablissements Chauvin S.a.r.l., France

[21] Appl. No.: 913,676

[22] Filed: Jul. 14, 1992

[30] Foreign Application Priority Data

Jul. 15, 1991 [FR] France ..... 91 09064

[51] Int. Cl.[5] ..... B07B 1/42; B07B 1/54

[52] U.S. Cl. ..... 209/365.4; 209/382; 209/383

[58] Field of Search ..... 209/323, 365.4, 379, 209/381, 382, 403, 383

[56] References Cited

U.S. PATENT DOCUMENTS

| | | | |
|---|---|---|---|
| 3,070,230 | 12/1962 | Peterson | 209/382 X |
| 4,122,006 | 10/1978 | Christensen et al. | 209/382 |
| 4,288,320 | 9/1981 | Wilson | 209/382 |
| 4,795,552 | 1/1989 | Yun et al. | 209/341 X |
| 5,037,537 | 8/1991 | Bielagus | 209/382 |

FOREIGN PATENT DOCUMENTS

| | | | |
|---|---|---|---|
| 2135323 | 1/1973 | Fed. Rep. of Germany . | |
| 2701341 | 7/1978 | Fed. Rep. of Germany | 209/382 |
| 8910068 | 5/1989 | Fed. Rep. of Germany . | |

*Primary Examiner*—D. Glenn Dayoan
*Assistant Examiner*—Tuan Nguyen
*Attorney, Agent, or Firm*—Davis, Bujold & Streck

[57] ABSTRACT

The device according to the invention comprises a vibrating frame (10) to which a vibrating housing (11) is attached, supporting a vibrating screen (12). Below this screen are attached a certain number of fixed bars (14), as well as a certain number of movable bars (15), each held at the extremity of two arms (16) attached by a flexible connection (17). The vibrating housing 11 is driven by a first electric motor (20) used during the normal screening process and a second electric motor (23) which rotates at a lower speed than that of the other motor (20) for unblocking the device by maintaining the movable bars in resonance so that they strike the lower surface of the vibrating screen (12). This device is particularly advantageous because it is adaptable to all vibrating machines.

13 Claims, 3 Drawing Sheets

SCREENING DEVICE AND METHOD

The present invention concerns a screening device comprising a fixed body supporting a vibrating framework to which is attached a vibrating housing supporting a screening device, with at least one movable bar below the screening device and parallel thereto and drive means for vibrating the vibrating housing, said bar being flexibly connected to said vibrating housing.

It also concerns a screening method implementing the above device.

Some known vibrating screens are equipped with unblocking devices which may consist of transverse bars activated from time to time to strike the inside surface of the vibrating screen. This shakes the screen and clears the material clogging its openings.

This method of operation often leads to relatively complex constructions which require expensive, heavy mechanical devices that are also cumbersome and sometimes undependable.

The present invention proposes overcoming these disadvantages by achieving a vibrating screen including an unblocking means of simple design which is lightweight and highly effective.

To achieve this, the device according to the invention is characterized in that said drive means is designed to make the frame and the screen vibrate for the purpose of screening, and also to maintain said arms and said bar in resonance so that the bar strikes the lower surface of the vibrating screen.

According to a particularly advantageous embodiment, said drive means may comprise at least one motor driving the vibrating housing and a variable speed device for said drive motor.

According to another embodiment, the drive means may comprise two drive motors, the first being designed to rotate at a predetermined speed corresponding to the screening operation speed and the second at a predetermined speed corresponding to the unblocking operation speed.

Said first drive motor is designed to rotate at a speed generally ranging from 500 to 1500 rpm, and preferably approximately equal to 1000 rpm. The second drive motor is designed to rotate at a lower speed than that of the first motor.

The speed of the second motor may range from 400 to 1000 rpm and is preferably in the area of approximately 800 rpm.

In these embodiments the pivotable arms supporting said bar may be flexible and affixed to the vibrating housing with rigid supports, or they may be rigid and affixed to the vibrating housing with flexible connection means.

The method according to the invention is characterized in that the vibrating housing is driven at a first drive speed during the screening phase and at a second drive speed during the unblocking phase.

The second speed is preferably lower than the first.

According to a variation of the method, the vibrating housing may be driven by a first driving motor during the screening phase and by a second driving motor during the unblocking phase.

The present invention will be better understood with reference to the description of one preferred embodiment and its variations, as well as to the attached drawing, in which.

Figure 1:
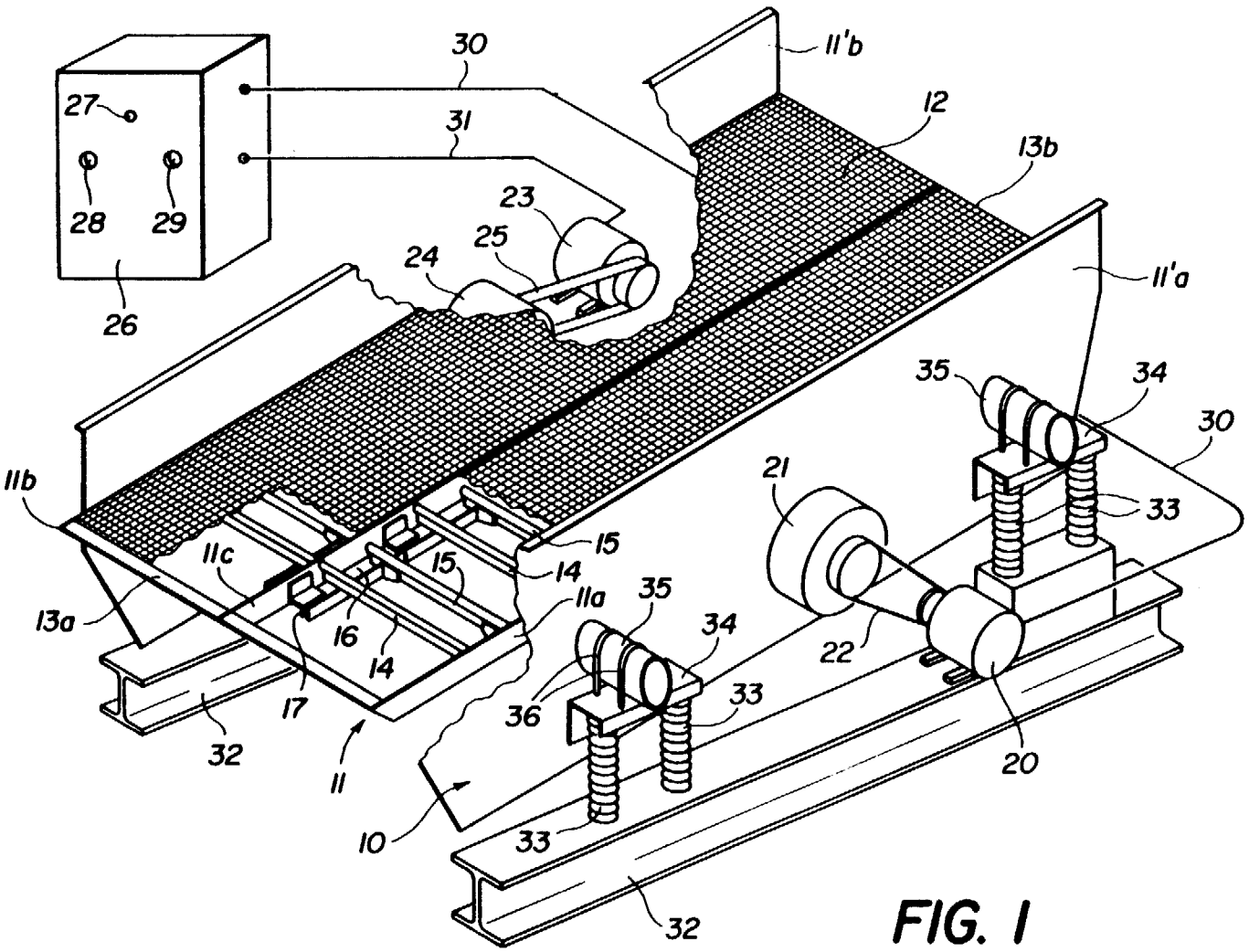
FIG. 1 is a perspective in partial cross-section of a vibrating screen according to the invention.

With reference to the drawings, the vibrating device shown in its entirety, specifically in FIG. 1, essentially comprises a vibrating framework 10 supporting a vibrating housing 11, holding a screen 12 onto which the materials for screening or shifting are poured. The vibrating housing 11 is composed of at least two lateral side pieces 11*a* and 11*b* and at least two transverse pieces 13*a* and 13*b* set at right angles to form a rectangle. In the embodiment shown in the drawing, a central side piece 11*c* is located at an equal distance from lateral side pieces 11*a* and 11*b*. A certain number of fixed bars 14 are transversely attached between lateral side pieces 11*a*, 11*b* and central side piece 11*c*. These bars are beneath the vibrating screen 12, parallel thereto, and function as supports for the screen, which is suspended between the two transverse pieces 13*a* and 13*b*.

Vibrating housing 11 comprises two lateral sides 11'*a* and 11'*b* to which lateral side pieces 11*a* and 11*b* are respectively attached.

In addition, a certain number of movable bars 15 are also attached below the vibrating screen 12 between lateral side pieces 11*a* and 11*b* of the vibrating housing 11 and central side piece 11*c*, respectively, parallel to fixed bars 14. The movable bars are preferably each disposed between two fixed bars and are set parallel to them at a predetermined distance from vibrating screen 12. This distance is determined so that during normal usage, the movable bars are virtually never in contact with the lower surface of the vibrating screen.

Figure 2:
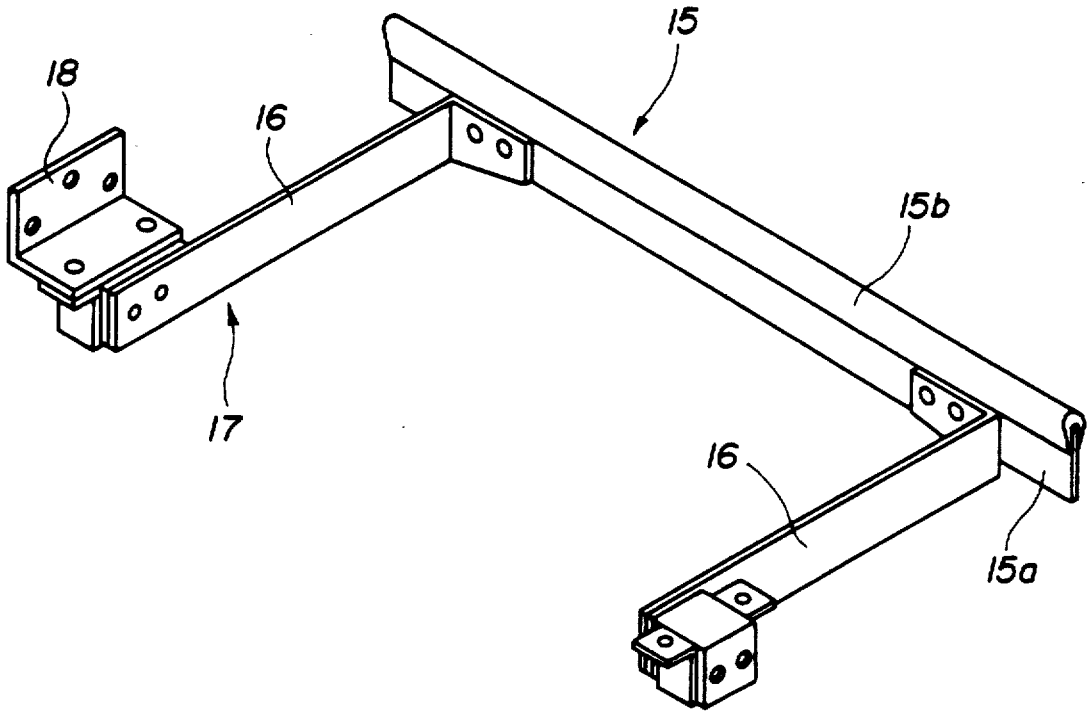
FIG. 2 is a partial perspective showing essentially one element of the unblocking system associated with the vibrating device of FIG. 1.

FIG. 2 shows one preferred embodiment of one realization of a movable bar 15 and the means for attaching it to vibrating screen 11. Movable bar 15 consists essentially of an elongate bar 15*a* surmounted by a strip 15*b* preferably made of elastomer. The bar is attached by two rigid arms 16 connected to the lateral side pieces and the central side piece of the vibrating housing by two flexible connectors 17. Connectors 17 are known in the art and, more specifically, may be DRA type flexible connectors sold by the Swiss company Rosta. Note that in this case arms 16 are rigid and are connected to the vibrating screen by means of flexible connectors. There is also another way to accomplish this. This consists of using flexible arms 16, perhaps in the form of flexible plates attached to the vibrating screen by rigid attachment elements. In the embodiment shown, flexible connectors 17 are attached to the lateral and central side pieces, respectively, by means of angle brackets 18.

Figure 3:
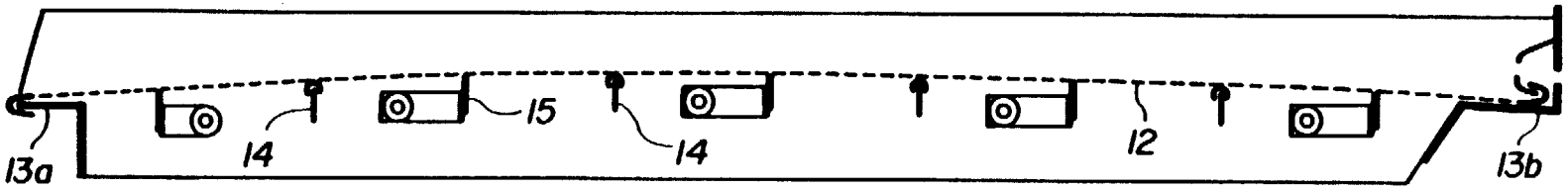
FIG. 3 is a longitudinal cross-section of the devices according to the invention.
Figure 4:
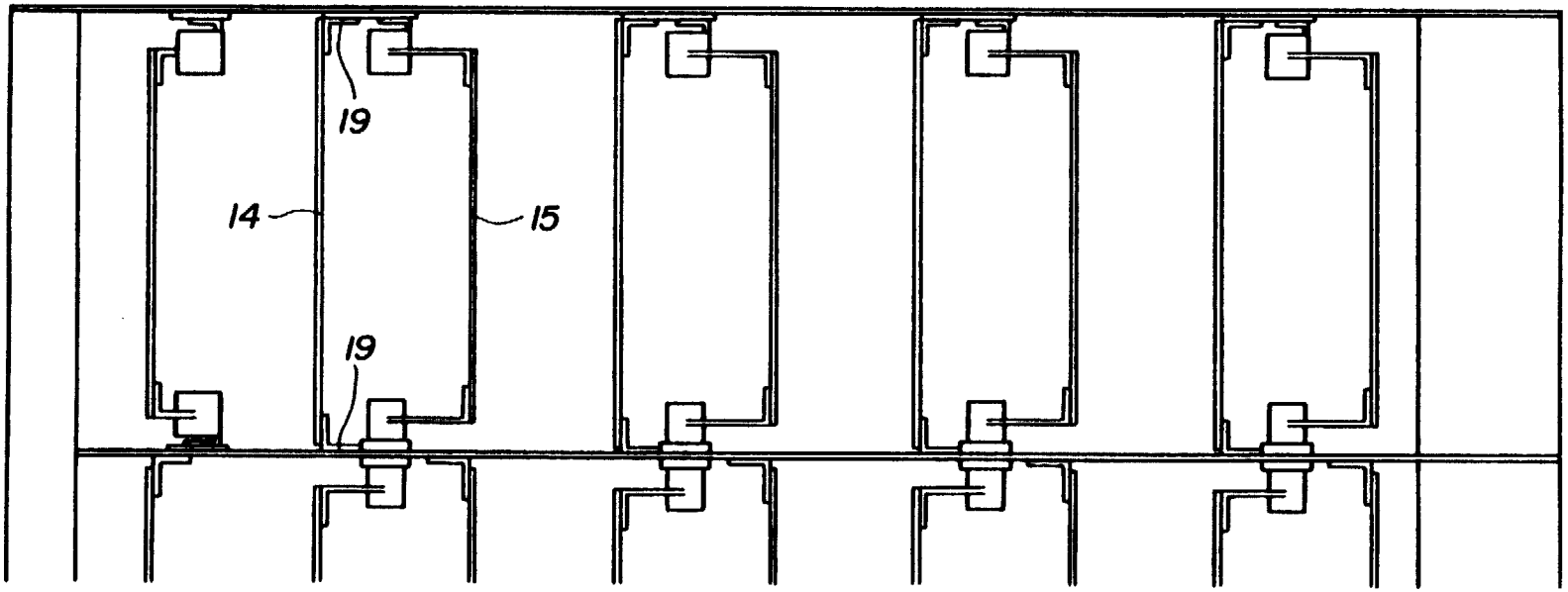
FIG. 4 is a partial overhead view showing the arrangement of the unit of fixed bars and movable bars.

FIGS. 3 and 4 illustrate certain details partially shown in the preceding views. Note that a movable bar 15 is associated with each fixed bar 14. The fixed bars are essentially identical in construction to the movable bars, but are attached directly to the side pieces by means of angle brackets 19.

Note also that vibrating screen 12 is slightly curved and supported by fixed bars 14. It is held at two opposite ends by cross pieces 13*a* and 13*b*.

The drive means for the vibrating screen comprises a first electric motor 20 driving a pulley 21 by means of at least one belt 22, said pulley driving weights which cause the vibration of the vibrating framework 10. Vibration can also be achieved by using excentrics or motor-vibrators. In the embodiment shown, the drive means also comprises a second electric motor 23 driving a pulley 24 by means of a belt 25. As before, pulley 24 is connected to an excentric or a weight (not shown) which causes vibrating housing 11 to vibrate. The first electric motor 20 may be designed to rotate at a speed V1 which is preferably in the range of from 500 to 1500 rpm and preferably in the area of 1000 rpm, and which corresponds to the normal drive speed for the screening process.

The second electric motor 23 rotates at a speed V2 which is preferably in the range of from 400 to 1000 rpm and advantageously in the area of 800 rpm to cause vibration of the vibrating housing, but also to maintain in resonance the movable bars attached to the arms which are, depending on the case, rigid and associated with flexible connectors, or flexible and associated with rigid connectors. The movable bars, when in resonance, are able to strike the lower surface of vibrating screen 12, and as a result, to unblock the screen.

The motor controls are situated in a housing 26 which has an on-off button 27 and two function selectors 28 and 29 for choosing the "vibrating" or the "unblocking" modes. Two supply cables 30 and 31 connect housing 26 with motors 20 and 23.

It should be understood that resonance frequency must be determined on a case to case basis as a function of the mass of the movable elements, that is, of the bar and of the arms, and the characteristics of the movable connectors. It is particularly advantageous to maintain the blocking system in resonance at a drive speed V2 which is lower than the drive speed V1 of the drive motor controlling the normal screening function of the machine. This type of embodiment using two motors is advantageous because it permits the use of standard motors, which are particularly economical. Another solution which uses only one electric motor associated with a variable speed device is of course possible. However, the variable speed device is a relatively expensive component which is also subject to breakdown.

Vibrating framework 10 must be suspended. For this reason, it is connected to a fixed framework composed of two metal elements 32 as a base for the unit, using paired helicoidal springs 33 to support plates 34 on which the extremities of shafts 35 are placed, the latter supporting lateral sides 11'a and 11'b. Bands 36 maintain the connection between shaft extremities 35 and support plates 34.

It is apparent that this embodiment may undergo different modifications and variations obvious to one skilled in the art. The number of movable bars depends upon the surface of the vibrating screen and/or upon the substance to be screened or sifted. The vibrating screen may be shaped differently from that shown in FIG. 1. The arrangement of the movable bars may be modified according to use.

We claim:

1. A screening device comprising:

a fixed body supporting a vibrating framework including a vibrating housing, said vibrating housing supporting a vibrating screen;

at least one movable elongate bar, supported by a pair of arms, being located below said vibrating screen and extending parallel to said vibrating screen, said at least one elongate movable bar being flexible connected to said vibrating housing; and drive means for vibrating said vibrating framework and said vibrating screen at a first frequency, during a screening operation, and for vibrating said vibrating framework and said vibrating screen at a second different frequency, during an unblocking operation, to maintain said arms and said at least one movable bar in resonance so that said at least one movable elongate bar strikes a lower surface of said vibrating screen to unblock said vibrating screen.

2. A screening device according to claim 1, wherein said drive means comprises at least one drive motor for driving said vibrating framework and a variable speed device for varying the speed of said at least one drive motor.

3. A screening device according to claim 1, wherein the drive means comprises first and second drive motors, said first drive motor for vibrating said vibrating framework at the first frequency and said second drive motor for vibrating the vibrating framework at the second frequency.

4. A screening device according to claim 3, wherein said first drive motor rotates at a speed of from about 500 to 1500 rpm.

5. A screening device according to claim 4, wherein said second drive motor rotates at a speed of from about 400 to 1000 rpm.

6. A screening device according to claim 3, wherein said second drive motor rotates at a speed lower than the speed of the first drive motor.

7. A screening device according to claim 1, wherein said flexible connection of said at least one elongate bar comprises flexible arms which are attached to the vibrating housing by rigid supports.

8. A screening device according to claim 1, wherein said flexible connection of said at least one elongate bar comprises rigid arms which are attached to the vibrating housing by flexible supports.

9. A screening device according claim 1, wherein a plurality of spaced apart fixed elongate bars extends perpendicularly from sidewalls of said vibrating framework, and a said flexibly connected elongate movable bar is located between each adjacent pair of fixed elongate bars.

10. A screening device according to claim 1, wherein said vibrating framework includes a central piece and two lateral side pieces, and a plurality of elongate flexibly connected movable bars each having a first end connected to one of said lateral side pieces and a second opposite end flexibly connected to said central piece.

11. A method of operating a screening device comprising a fixed body supporting a vibrating framework including a vibrating housing, said vibrating housing supporting a vibrating screen; at least one movable elongate bar being located below said vibrating screen and extending parallel to said vibrating screen, said at least one elongate movable bar being flexible connected to said vibrating housing; and at least one drive motor for vibrating said vibrating framework, said method comprising the steps of:

vibrating said framework, with said at least one drive motor, at a first frequency during a screening process; and vibrating said framework, with said at least one drive motor, at a different second frequency, during an unblocking process, in which said second frequency maintains said at least one bar in resonance so that said at least one bar strikes a lower surface of said vibrating screen.

12. A screening method according to claim 11, further comprising the steps of:

vibrating said framework with a first drive motor during a screening operation; and vibrating said framework with a second drive motor during a screen unblocking operation.

13. A screening method according to claim 12, further comprising the step of operating said second drive motor at a speed which is slower than a speed of said first drive motor.

* * * * *